US007836653B1

(12) United States Patent
Herrington

(10) Patent No.: US 7,836,653 B1
(45) Date of Patent: Nov. 23, 2010

(54) AIR CONDITIONER COVER

(75) Inventor: Randy D. Herrington, 273 Kinnard Rd., Franklin, KY (US) 42134

(73) Assignee: Randy D. Herrington, Franklin, KY (US)

( * ) Notice: Subject to any disclaimer, the term of this patent is extended or adjusted under 35 U.S.C. 154(b) by 179 days.

(21) Appl. No.: 11/946,068

(22) Filed: Nov. 28, 2007

Related U.S. Application Data

(63) Continuation-in-part of application No. 11/138,547, filed on May 26, 2005, now abandoned.

(51) Int. Cl.
*E06B 7/08* (2006.01)

(52) U.S. Cl. ..... 52/473; 52/202; 52/5; 52/78; 49/465; 49/51; 49/57; 454/347; 256/25

(58) Field of Classification Search ..... 52/79.1, 52/3, 4, 5, 23, 78, 478; 256/24, 25, 26, 27, 256/67; 47/17; 62/262, 263, 265; 49/465, 49/463, 464, 51, 57; 454/347
See application file for complete search history.

(56) References Cited

U.S. PATENT DOCUMENTS

| | | | | | |
|---|---|---|---|---|---|
| 404,577 | A | * | 6/1889 | Thatcher | 52/5 |
| 2,723,107 | A | * | 11/1955 | Parker | 256/24 |
| 2,967,533 | A | | 1/1961 | Ballinger | |
| D244,293 | S | | 5/1977 | Carluccio | |
| 4,953,328 | A | | 9/1990 | Sewell et al. | |
| 5,097,678 | A | | 3/1992 | Aubuchon | |
| 5,155,961 | A | * | 10/1992 | Bardo | 52/646 |
| 5,362,030 | A | * | 11/1994 | Iler et al. | 256/65.08 |
| 5,660,054 | A | | 8/1997 | Rice | |
| 5,702,090 | A | * | 12/1997 | Edgman | 256/19 |
| 6,138,993 | A | | 10/2000 | Mitchell et al. | |
| 6,158,175 | A | | 12/2000 | Carter | |
| 6,186,158 | B1 | | 2/2001 | Goarin | |
| 6,217,007 | B1 | * | 4/2001 | Grayson et al. | 256/24 |
| 6,430,954 | B1 | | 8/2002 | Smith | |
| 2002/0121101 | A1 | | 9/2002 | Jebaraj | |
| 2005/0022853 | A1 | | 2/2005 | Scissom | |

* cited by examiner

*Primary Examiner*—Richard E Chilcot, Jr.
*Assistant Examiner*—Chi Nguyen

(57) ABSTRACT

The present invention discloses an air conditioner cover having at least two posts, a plurality of slats, and a plurality of obstructions used to properly distance the slats from the ground. The air conditioner cover also has connectors disposed between said posts and said slats in some embodiments. The air conditioner cover is designed to surround an air conditioner unit in order to hide it from sight and to protect the air conditioner unit from various types of damage. The present invention is specifically designed to ensure appropriate ventilation, as the uniquely shaped slats have in order to provide a spacing gap for ventilation purposes, while still providing a barrier to the air conditioner unit.

14 Claims, 12 Drawing Sheets

AIR CONDITIONER COVER

CROSS REFERENCE TO RELATED APPLICATIONS

This application is a continuation-in-part and claims priority of U.S. patent application Ser. No. 11/138,547 filed on Dec. 14, 2005 which is hereby incorporated by reference.

STATEMENT REGARDING FEDERALLY SPONSORED RESEARCH OR DEVELOPMENT

Not applicable

REFERENCE TO A "MICROFICHE APPENDIX"

Not applicable

FIELD OF THE INVENTION

The present invention relates to the protection and preservation of air conditioner units, and more particularly to devices that shield air conditioner units.

BACKGROUND OF THE INVENTION

As a necessity, air conditioner units are placed outside and adjacent to the house, or building, which is receiving air conditioning due to the unit. Although such air conditioner units are constructed to maintain proper function and be somewhat resistant to natural environmental hazards, such as wind, sun, rain, and snow, a benefit is received by taking steps to further protect the air conditioner unit from those, and other, hazards. Additionally, air conditioner units are subject to damage due to playing children, malicious adults, or other inadvertent damage as a consequence of the location of the air conditioner unit. Currently, the consequences associated with a damaged air conditioner units are well documented. When an air conditioner unit is damaged, or malfunctions, there is a cost associated with repairing the damaged unit, and, perhaps more importantly, as the unit is non operational, the occupants of the adjacent house, or building, are inconvenienced and uncomfortable due to the interruption of the air conditioning service. If the probability of damage to an air conditioner unit is reduced, the resulting advantage would be a reduction in maintenance costs and uninterrupted air conditioning service for the occupants of the effected house or building.

Accordingly, there is a need for an air conditioner cover such as the one described herein. The present invention is designed to surround an air conditioner until without interfering with the ventilation needs of that unit.

SUMMARY OF THE INVENTION

The present invention discloses an air conditioner cover. The air conditioner cover provides the advantages of allowing adequate ventilation while hiding the air conditioning unit from sight and enhancing the look of the immediate area by matching the construction characteristics of the building which is adjacent thereto. The present invention is quickly constructed and provides adequate ventilation to allow the proper function of the air conditioning unit. The present invention may be used in many different settings as the length of the slats are adjustable. Specifically, the air conditioner cover includes a plurality of posts, a plurality of slats removably attached to the posts, such that the slats are adjustable in length and the slats obstruct the view of air condition and allows for ventilation, and an obstruction attached to the plurality of posts. The plurality of slats attaches to the posts forming a side that acts as a visibility barrier for the air conditioner unit. Multiple sides may be positioned adjacent to each other to adequately block the air conditioner unit from view.

In certain embodiments, the slats are u-shaped. In alternate embodiments, the air conditioner cover also includes a top railing attached to at least one of the plurality of posts or slats. In other embodiments, a plurality of connectors is disposed between said posts and said slats. Said connectors are removably attached to said posts and receive said first or second end of said slats. In certain embodiments of the invention, the slats are constructed of light weight materials, such as metal, plastic, fiberglass, siding, vinyl, or the like. In other embodiments, an obstruction is attached to a post so that a distance of at least six inches exists between the first end of the post, or the surface of the ground, and each of the plurality of the slats. In still other embodiments, each slat has as first member and a second member, the second member being slideably engaged to the first member so that the length of each slat is adjustable. In still other embodiments, the air conditioner cover also includes said posts having a groove. Said groove capable of receiving the first member or the second member of the slat or a guide of said connecting member.

In still other embodiments, the air conditioner condenser cover includes at least two posts, each post defining a plurality of grooves and defining an opening, a plurality of slats attached to the posts, each slat having a first end, a second end, and a body, and wherein the first end of each slat is inserted into one of the grooves defined by one of the posts and the second end of the slat is inserted into one of the grooves defined by another of the posts. Still other embodiments include a top railing attached to the posts. Alternate embodiments also include a post cap attached to the top of the post. Still other embodiments include slats which are adjustable in length. Still other embodiments include a plurality of slats further including a first member having a first end and a second member having a second end slideably engaged to the first member. In still other embodiments, the second member has a first u-shaped portion and a second u-shaped portion so that the second member slidably engages the first member. In still other embodiments, there are a plurality of obstructions inserted into the plurality of grooves of the posts so that the slats are spaced from the ground a distance of the length of each obstruction.

In another embodiment, the air conditioner cover includes at least two posts, each post having a plurality of grooves and defining an opening. A plurality of connectors are removably attached to said post, said connectors having guides wherein said guides slide into said grooves in said posts. Said connectors having slots for receiving slats. A first end of one of a plurality of slats is received by one of said plurality of slots said slots connected to one of said plurality of posts. A second end of one of a plurality of slats received by another of a plurality of slots connected to another of said plurality of posts, such that the slats cover said opening between said posts.

In still other embodiments of the present invention, the air conditioning unit cover includes a housing having a first side, a second side, and a third side, a frame attached to the housing, and a plurality of louvers attached to the frame, wherein the frame is angled relative to the housing. In certain embodiments, the frame is adjustable in size. In still other embodiments, the louvers attach to the frame swivel so that bursts of exhausted air from the air conditioner unit swivel the louvers to an open position. In certain embodiments, the length of the louvers is adjustable. In still other embodiments, the present invention further includes a side enclosure attached to the frame.

Accordingly, one aspect of the present invention is to provide an air conditioner cover which removes from sight the air conditioner unit.

Another aspect of the present invention is to provide an air conditioner cover which provides adequate ventilation to maintain the efficiency of the air conditioner unit.

Still another aspect of the present invention is to provide an air conditioner cover which protects and shields an air conditioner unit from damage due to hazards including, but not limited to, wind, sun, rain, snow, and other inadvertent or malicious damage.

Still another aspect of the present invention is to provide an air conditioner cover which is quickly constructed and provides slats having adjustable lengths.

Another aspect of the present invention is to provide an air conditioner cover having adequate spacing from the ground in order to provide sufficient ventilation for the air conditioner unit.

Still another aspect of the present invention is to provide an air conditioner cover having a spacing gap between the slats to provide ventilation.

Yet another aspect of the present invention is to provide an air conditioner cover having connectors which attach to the posts and slats for easy assembly and manufacture.

DETAILED DESCRIPTION OF THE INVENTION

Figure 1:
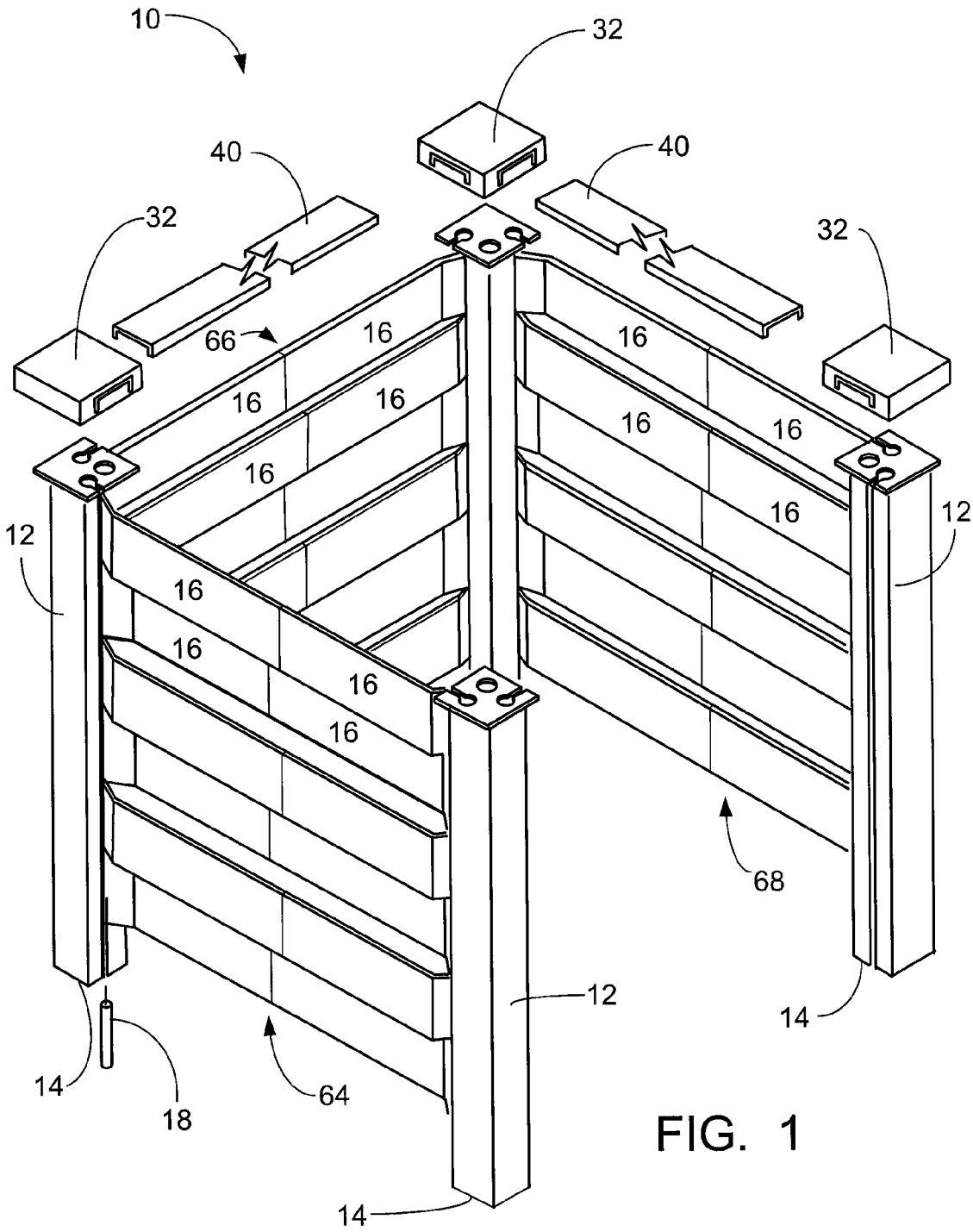
FIG. 1 is a perspective view of one embodiment of the air conditioner cover of the present invention.

The invention disclosed herein is an air conditioner cover 10. The air conditioner cover 10 has a plurality of posts 12, a plurality of slats 16, and a plurality of obstructions 18. In one embodiment, the air conditioner cover 10 has a plurality of connectors 75. One advantage provided by the present invention is that appropriate air ventilation is present even though the air conditioner unit 36 is hidden from site. Further, there is an embodiment including a top 38, which covers the top of the air conditioner unit 36, so that the entire air conditioner unit 36 is not visible, even in situations in which the air conditioner unit 36 is located at a lower elevation relative to the surrounding property which is when the top of the air conditioner unit 36 would otherwise be visible. Since the slats 16 may be constructed of a material or color similar or identical to that of the adjacent house, or building, an aesthetic enhancement is also provided by the present invention.

Shown in FIG. 1 is a prospective view of a first embodiment of the present invention. There is shown the air conditioner cover 10 (air conditioner unit 36 not shown). The air conditioner cover 10 includes a plurality of posts 12, a plurality of slats 16, and a plurality of obstructions 18. The air conditioner cover 10 may be constructed of any rigid material which is sturdy and durable enough for the function described herein. Examples of materials of construction include, but are not limited to, a metal, such as aluminum or other alloy, a rigid plastic, fiberglass, siding or the like. The air conditioner cover 10 may be fabricated by typical machining, forging or molding known by those of ordinary skill in the art. As further described herein, the individual parts of the air conditioner cover 10 are attached by fastening, sliding engagement, interlocking, or other common manners of attachment known in the art. In certain embodiments of the present invention, the top of the air conditioner cover 10 may include a post cap 32 and top railing 40. It is noted that the top railing is of sufficient width to cover the slats 16 (See FIGS. 2B and 4). Regarding the post caps 32, various decorative elements, such as cones, balls, triangular shapes and the like, may be used to enhance the overall appearance of the air conditioner cover 10.

Figures 2A, 2B, 2C:
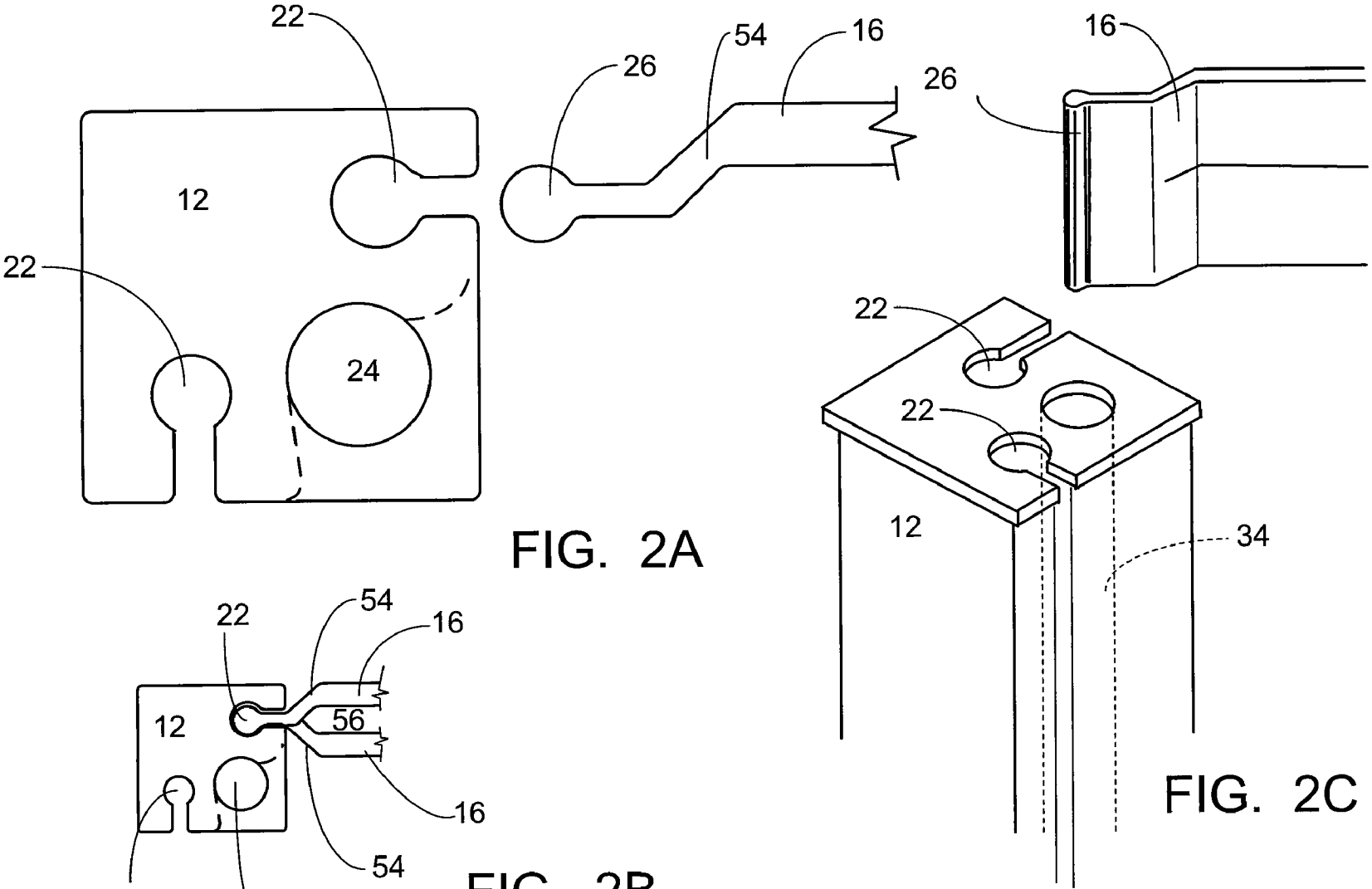
FIG. 2A is a top view of one embodiment of a post and a slat of the air conditioner cover of the present invention.
FIG. 2B is a top view of another embodiment of a post and a slat of the air conditioner cover of the present invention.
FIG. 2C is perspective view of another embodiment of a post and a slat of the air conditioner cover of the present invention.

Referring now to FIGS. 2A-2C, there is shown various views of the manner of attachment between the post 12 and slat 16. Specifically referring to FIG. 2A, there is shown a top view of a post 12 defining a plurality of grooves 22 and defining an opening 24. Each groove 22 may have a unique shape which corresponds to a first end 26 or a second end 28 of a slat 16. The groove 22 may receive a first end 26 or second end 28 by sliding such end into the groove 22 at either end of the post 12. Once the first end 26 or second end 28 is inserted in to the groove 22 it may slide the length of the post 12. However, it may not disengage the groove 22 unless slid to either end of the post 12. The opening 24 of the post 12 may receive a rod 34, also known as a dowel, the rod 34 being firmly implanted within the ground such that the post 12 is held in its proper vertical position due to the engagement with the rod 34. Referring now to FIG. 2C, there is shown a prospective view of the post 12 receiving a slat 16. The slat 16 is placed above the post 12 such that the first end 26 of the slat 16 is dropped into the groove 22. Also shown is the rod 34, shown by phantom lines, within the opening 24 of the post 12. Also shown is another groove 22 on the opposite side of the post 12 which may also be used to receive slat 16.

Figure 9:
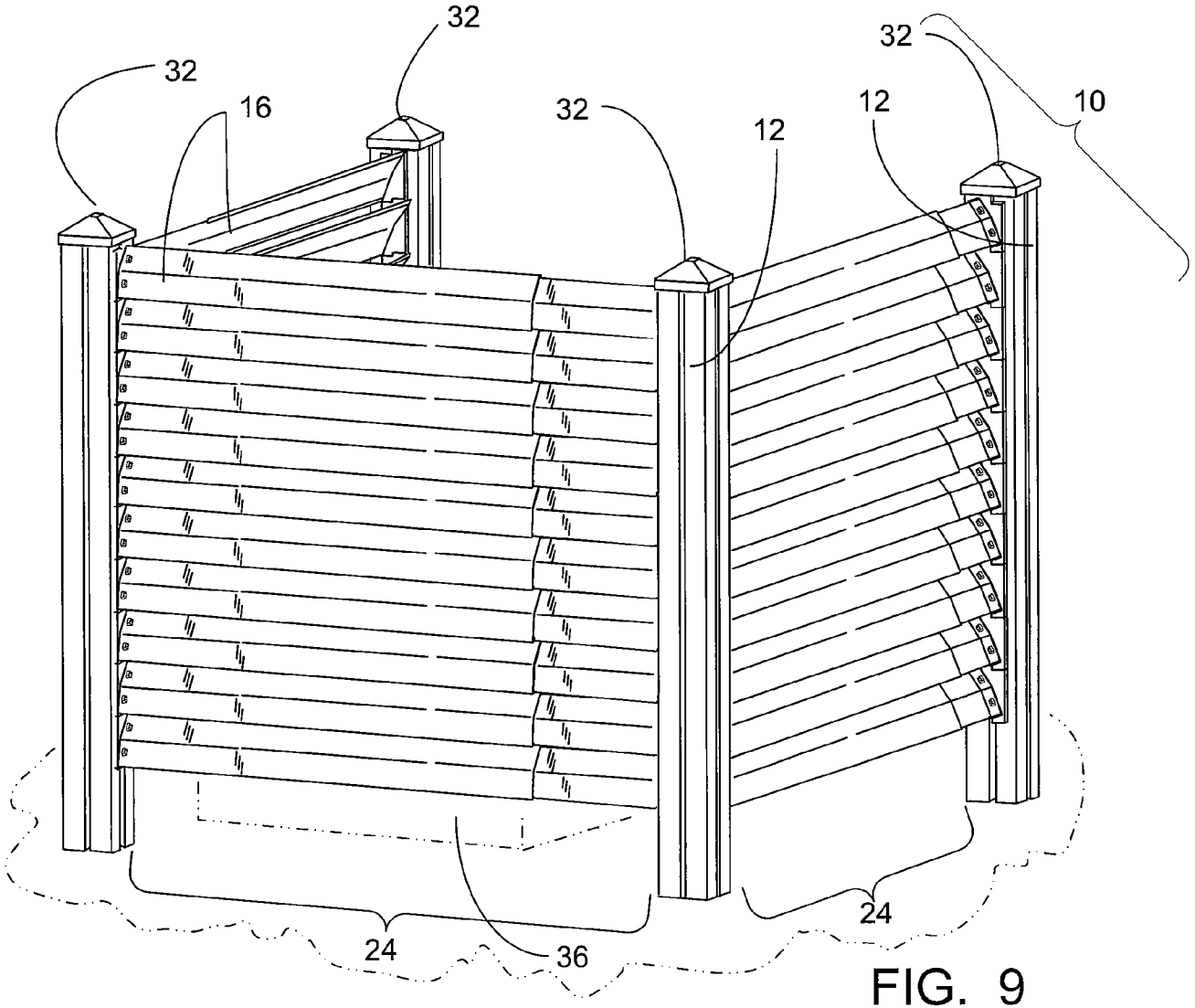
FIG. 9 is a perspective view of one embodiment of the air conditioner cover of the present invention.

Referring now to FIG. 9, in one embodiment, the air conditioner cover 10 has at least two posts 12, each post 12 having a plurality of grooves 22, and defining an opening 24 there between. Said air conditioner cover 10 has a plurality of connectors 75 as shown in FIG. 12. Each connecting member 75 has a slot 76 for receiving a slat 16, and a guide 77 for attaching the connecting member 75 to said groove 22. In this embodiment, the grooves 22 have an identical shape. The groove 22 receives the guide 77 by sliding such guide 77 into the groove 22 at either end of the post 12. (See FIGS. 12 and 13). Once the guide 77 is inserted into the groove 22, it may slide the length of the post 12; however, it may not disengage the groove 22 unless slid to either end of the post 12. (See FIG. 11) In some embodiments, each slot 76 is affixed to a connector 75 at an angle such that the slat 16 is at an angle when connected to slot 76. The angle of the slot 76 is small enough such that, when multiple slats 16 are installed, the air conditioner unit 36 is out of sight, but the angle is large enough to provide ventilation. The connecting member 75 may be constructed of any rigid material which is sturdy and durable enough for the function described herein. Examples of materials of construction include, but are not limited to, a metal, such as aluminum, stainless steel, or other alloy, a rigid plastic, fiberglass, siding, vinyl or the like.

Figure 16:
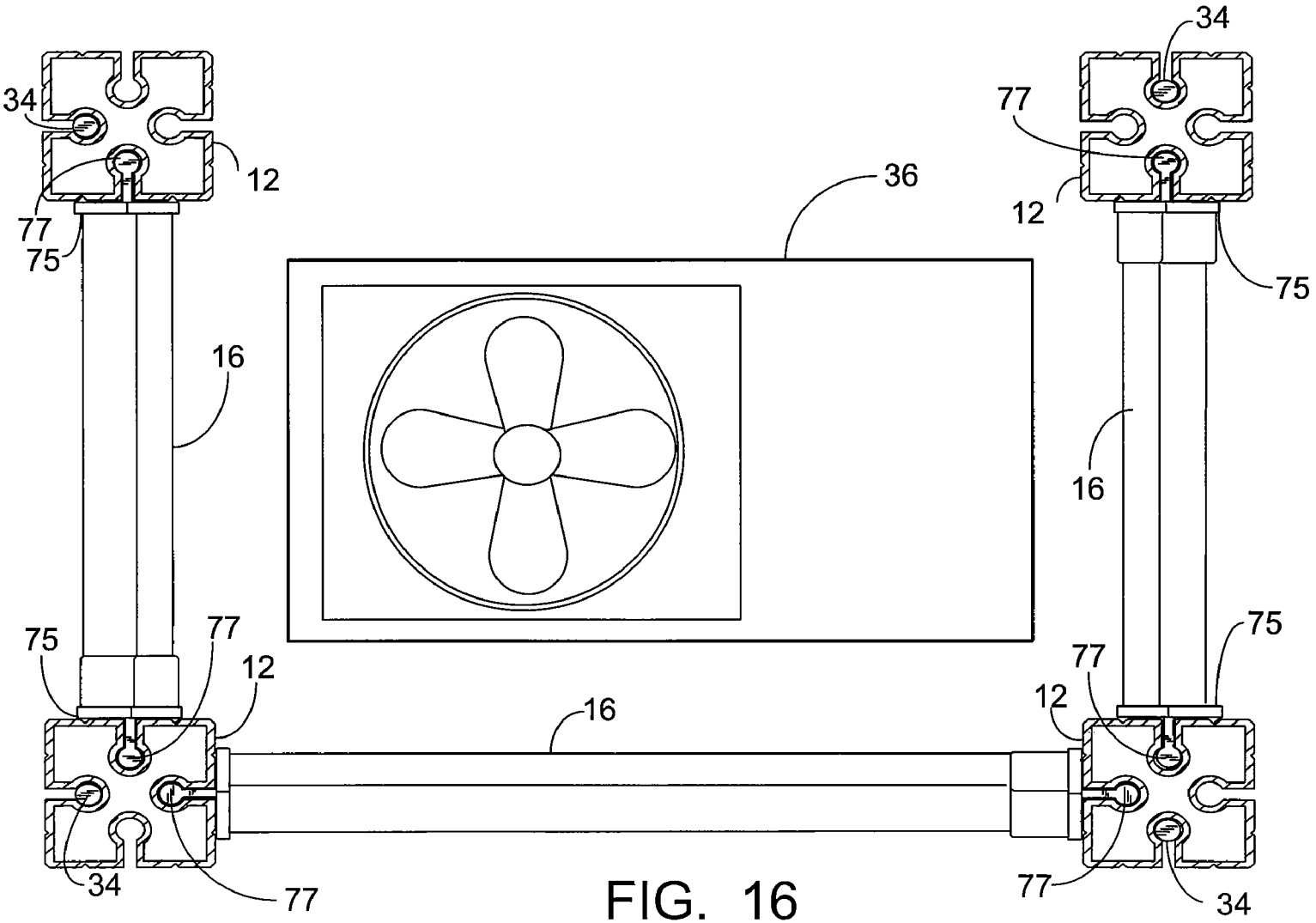
FIG. 16 is a top view of one embodiment of the air conditioner cover of the present invention.

A plurality of connectors 75 are inserted into said grooves 22. A first end 26 of said slat 16 is received by a first slot 76 connected to a first post 12. (See FIG. 12) A second end 28 of said slat 16 is received by a second slot 76 connected to a second post 12. Additional slats 16 are added in this manner until said slats 16 block said opening 24 and said air conditioner cover 10 obscures said air conditioner unit 36 from view. (See FIG. 9) Additional posts 12 may be added to the air conditioner cover 10, defining another opening 24 there between. When a plurality of slats 16 are installed, the slats 16 cover the opening 24 obscuring the air conditioner cover 10 from view. In another embodiment, the posts 12 define three openings 24 surrounding the air conditioner unit 36. When the slats 16 are added, three sides of the air conditioner unit 36 are obscured from view by the air conditioner cover 10. (See FIG. 16) One groove 22 of the post 12 may receive a rod 34, also known as a dowel, the rod 34 being firmly implanted in the ground such that post 12 is held in its proper vertical position due to the engagement with the rod 34. (See FIG. 11)

In another embodiment, the first end 26 and second end 28 are fastened to the slot 76 such that the slat 16 cannot become disengaged from the slot 76. There are many ways known to those of skill in the art that the slat 16 can be fastened to the slot 76. For example, in the present invention, there is at least one projection 90 on the slot 76. (See FIGS. 12 and 13) Said first projection 90 on a first slot 76 fits into a first hole 91 on said first end 26 and a second projection 90 on a second slot 76 fits into a second hole 91 on said second end 28, securely fastening said slat 16 to said connectors 75. Said slat 16 can be detached from said connecting member 75 by depressing said projections 90 so that said projections 90 do not protrude through said holes 91 and withdrawing said slat 16 from said slot 76.

Figure 7:
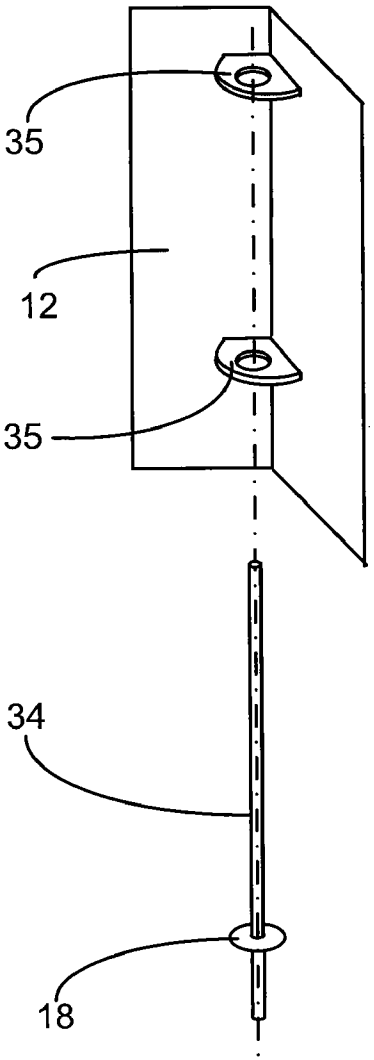
FIG. 7 is a perspective view of one embodiment of a post of the air conditioner cover of the present invention

In alternate embodiments, the post 12, or other vertical member, may be attached to the slats 16 by riveting, welding, or the like. In certain embodiments, the rod 34 may be inserted into loops 35 attached to the interior sides of posts 12, as seen in FIG. 7. In certain embodiments, an entire air conditioner cover 10 may be constructed of aluminum, vinyl, or the like and attached by riveting, welding, or the like.

Figure 3A:
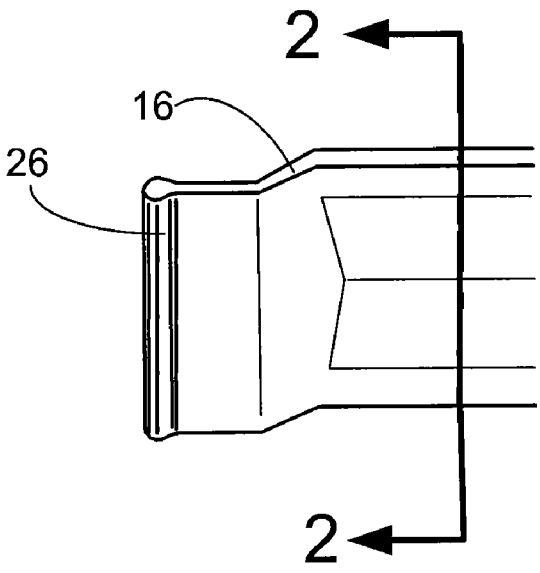
FIG. 3A is a side view of one embodiment of a slat of the air conditioner cover of the present invention.
Figure 3B:
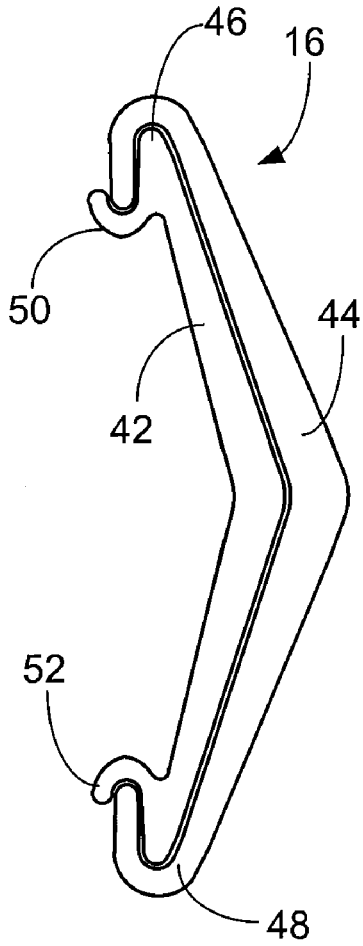
FIG. 3B is a side view of another embodiment of a slat of the air conditioner cover of the present invention.

Referring now to FIGS. 3A and 3B, there is shown the first end 26 and second end 28 of a slat 16. In certain embodiments, the first end 26 and second end 28 may be identical. In alternate embodiments, there may be differences between the first end 26 and the second end 28 in order to provide orientation to the individual assembling the air conditioner cover 10. In any type of embodiment, the ornamental characteristics of the slat 16 may be modified in order to closely match the aesthetic characteristics of the adjacent building, as is shown by the various patterns of the slats in FIGS. 3A and 3B. In certain embodiments, the slat 16 of the present invention may be constructed of two parts such that the overall length of the slat 16 is adjustable. Specifically referring to FIG. 3C, there is shown a cross sectional view of a slat 16 shown in FIG. 3A. The location of the cross section is indicated by line 2. Shown in FIG. 3C, the slat 16 includes a first member 42 slideably engaged by a second member 44. Although the specific manner of engagement may occur in a variety of ways, in the present embodiment, the second member 44 has a first u-shaped section 46 and a second u-shaped section 48 which surround the first member 42. The first member has a first j-shaped section 50 and a second j-shaped section 52 which further engage the first u-shaped section 46 and the second u-shaped section 48, respectively, of the second member 44. Accordingly, a first member 42 may slideably engage a second member 44 such that the slat 16 has a first end 26 and a second end 28 which may then be slideably engaged to respective grooves 22 of the plurality of posts 12. In certain embodiments, the first member 42 and second member 44 are constructed of the same materials as the slats 16 described herein.

Figure 13:
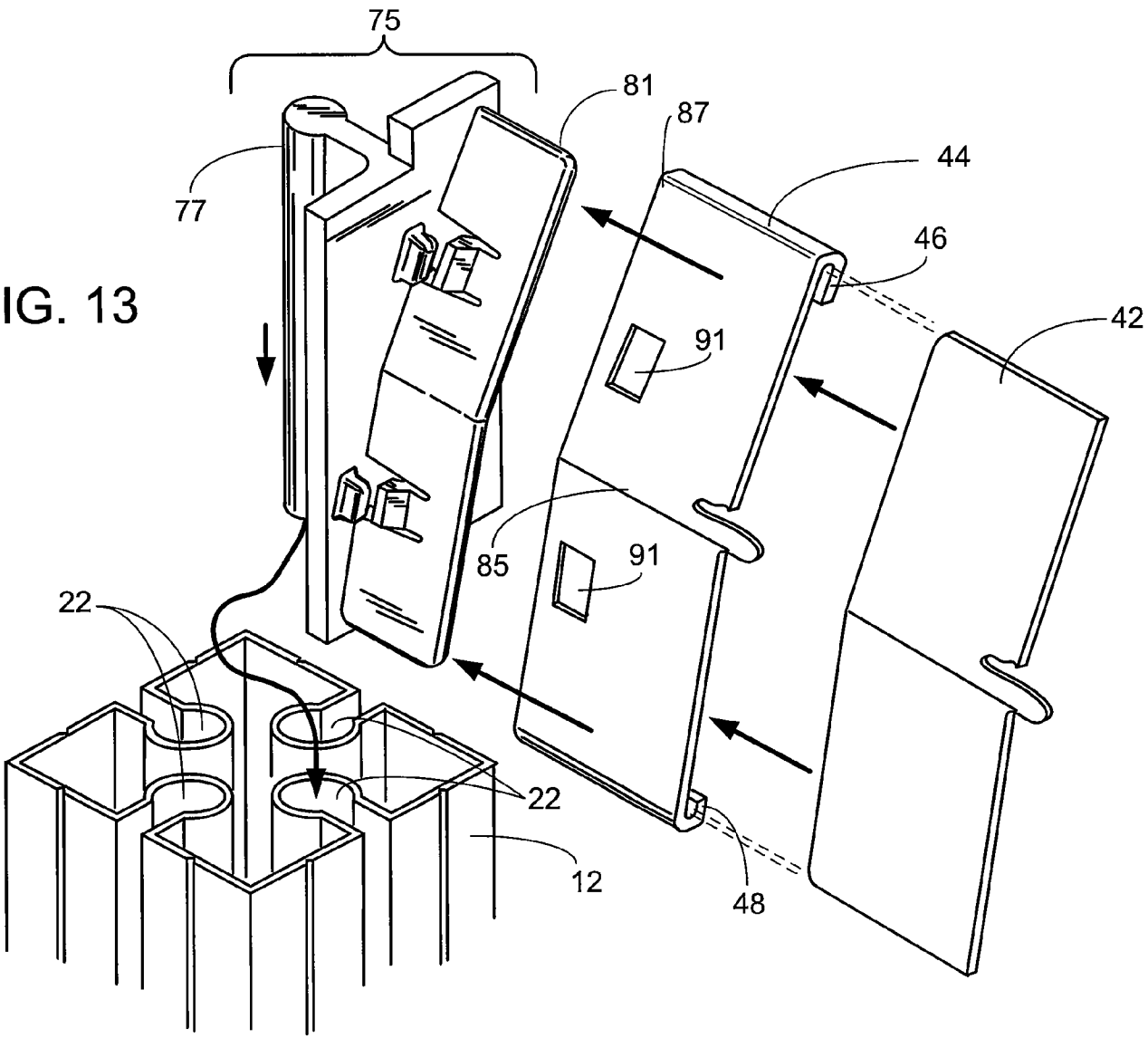
FIG. 13 is a perspective view of another embodiment of a connector and a post of the air conditioner cover of the present invention.
Figures 14, 15:
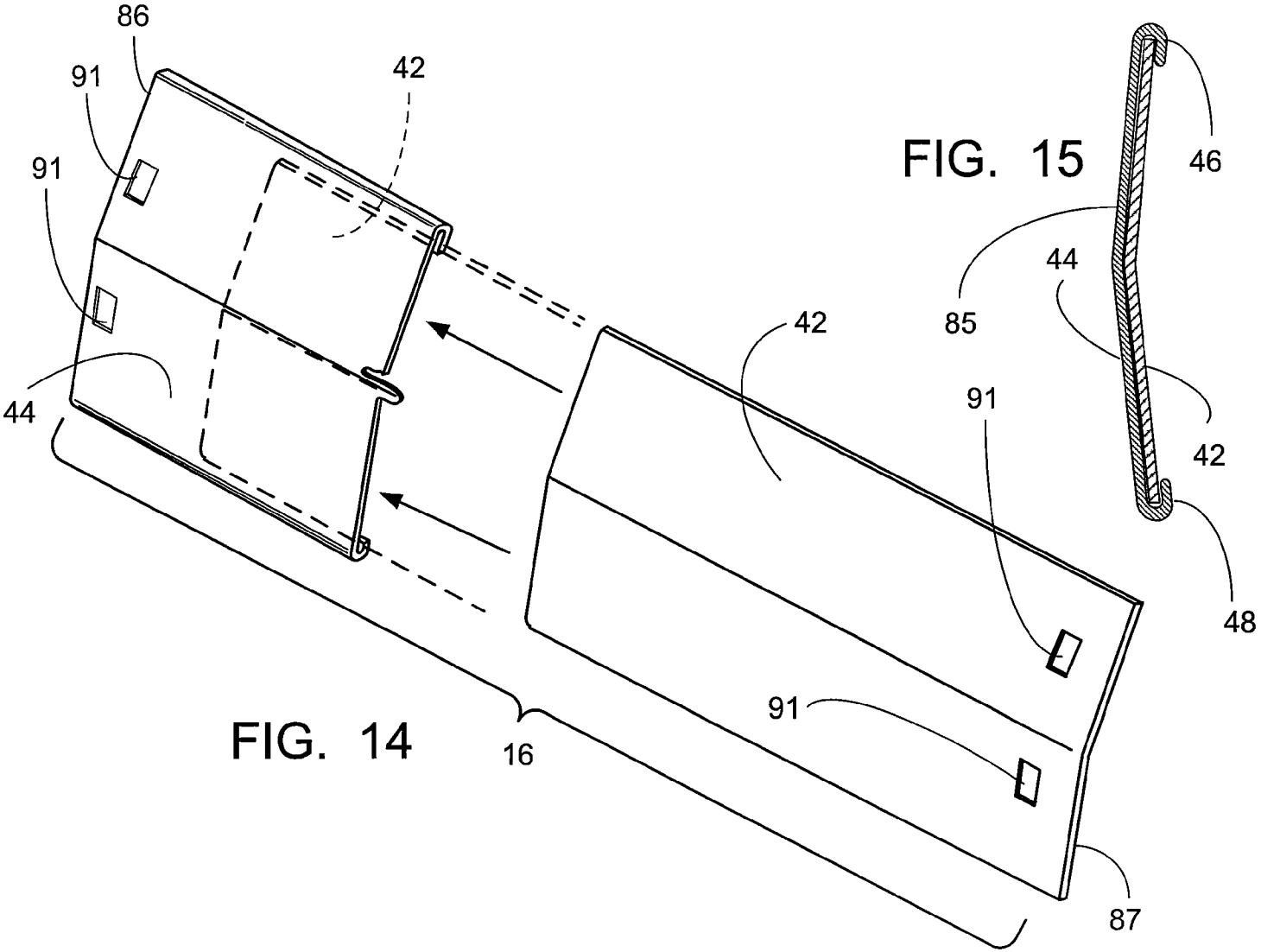
FIG. 14 is a perspective view of one embodiment of a slat of the air conditioner cover of the present invention.
FIG. 15 is a cross sectional view of one embodiment of a slat of the air conditioner cover of the present invention.

Referring now to FIG. 14, in an embodiment where the adjustable slats 16 are received by connectors 75, the slat 16 has a first member 42 slideably engaged by a second member 44. Another manner of engagement occurs where said second member 44 has a first u-shaped section 46 and a second u-shaped section 48 as shown in FIG. 15. The first member 42 is disposed between the body 85 of the second member 44 and u-shaped sections 46 and 48 such that said first member 42 may slide horizontally with respect to said second member 44, but will not become disengaged from said second member 44. An end 86 of said first member 42 fits inside a female slot 76 of a connecting member 75. Referring now to FIG. 13, an end 87 of said second member 44 fits over a male slot 81 such that said male slot 81 is disposed between said body 85 of said second member 44 and said u-shaped sections 46 and 48.

Figure 4:
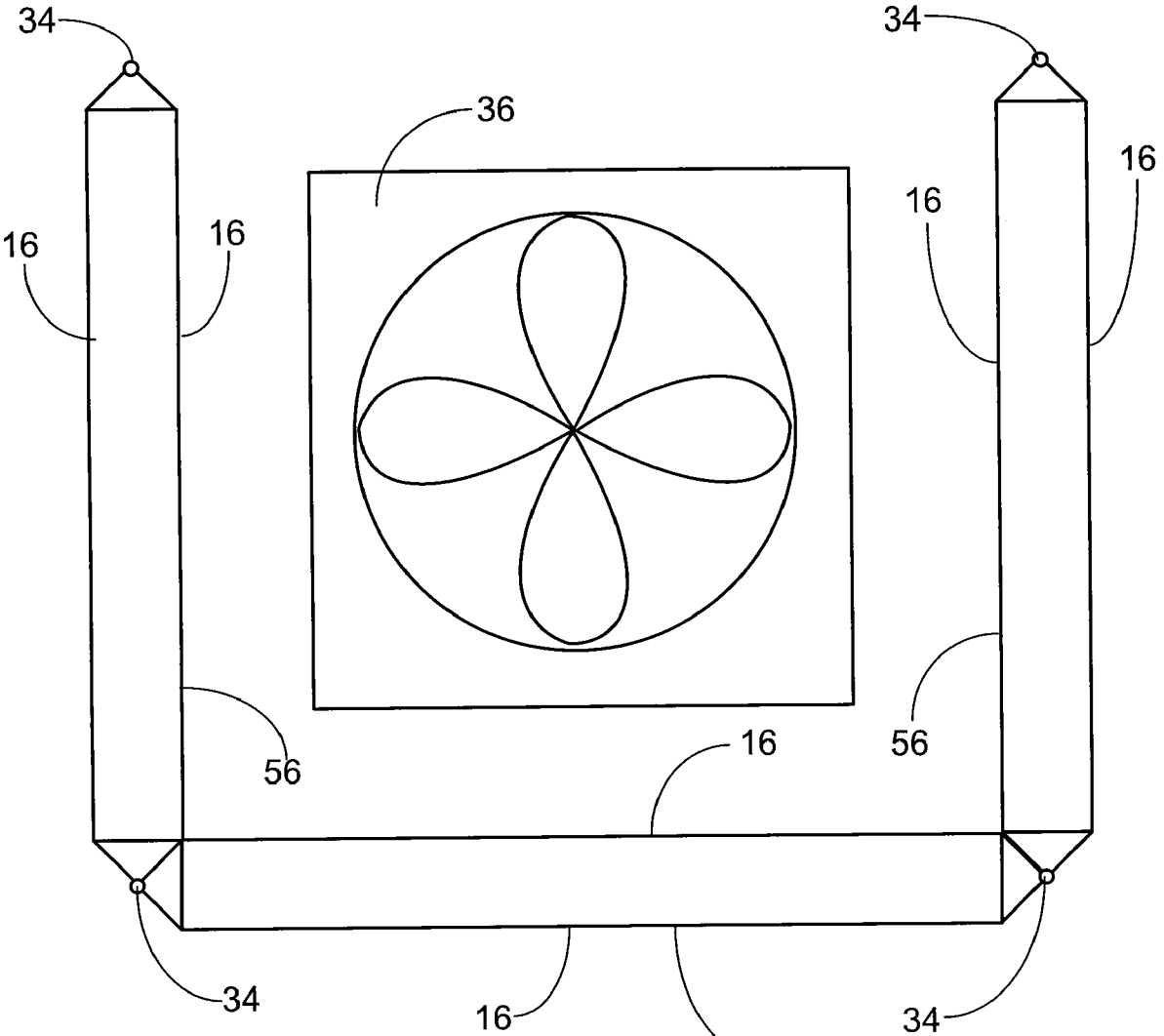
FIG. 4 is a top view of one embodiment of the air conditioner cover of the present invention.

Referring now to FIGS. 2A and 2B, in another embodiment, there is shown the bent section 54 of the slat 16. When the slat 16 engages the groove 22 of the post 12, the slat may be orientated such that the bent section 54 extends away from or extends toward the air conditioner unit 36. As the slats 16 between two specific posts 12 are placed in position, the orientation of the bent section 54 may be alternated such that a first slat 16 extends away from the air conditioner unit 36, the next slat 16 extends towards the air conditioner unit 36, the following slat 16 then extends away from the air conditioner unit 36, and so on, such that a spacing gap 56 is present between the alternating slats 16. Referring now to FIG. 4, there is shown a top view of the air conditioner unit 36 surrounded by the air conditioner cover 10 of the present invention. Specifically, the spacing gap 56 is present due to the alternate positioning of the slats 16, as best seen in the side view shown in FIG. 5.

Figure 5:
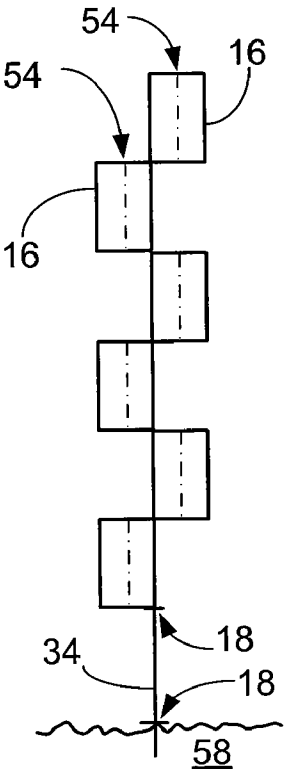
FIG. 5 is a side view of one embodiment of the air conditioner cover of the present invention.
Figure 11:
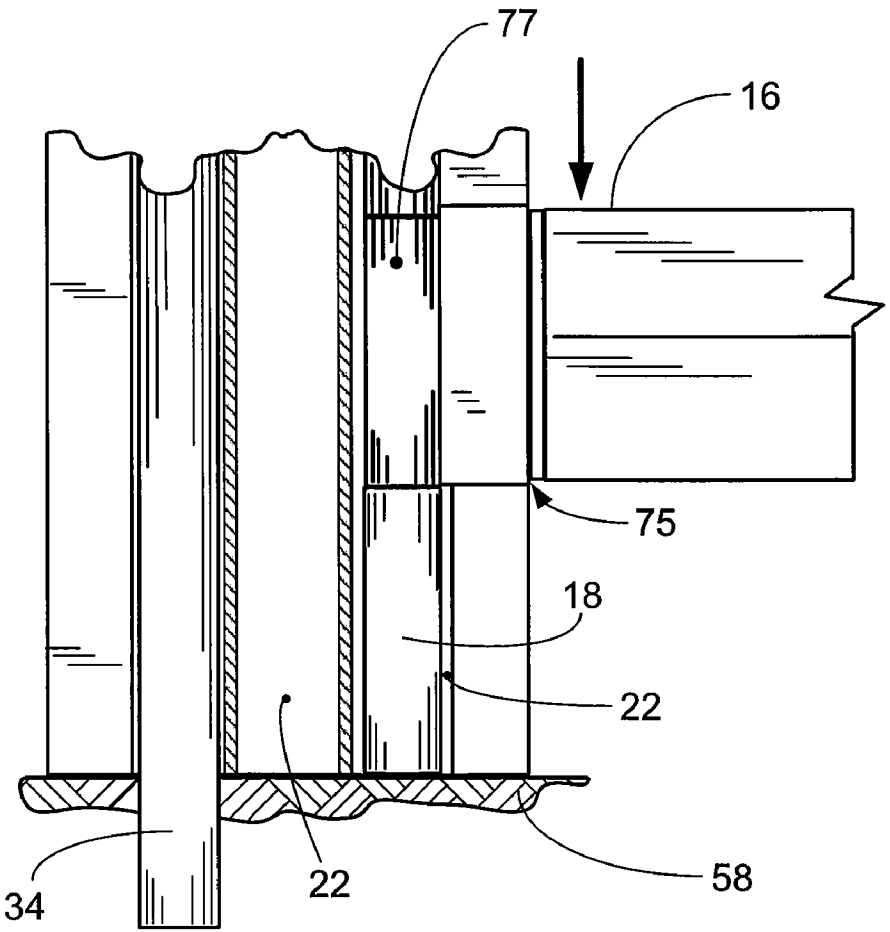
FIG. 11 is a side view of one embodiment of the bottom of a post and obstruction of the air conditioner cover of the present invention.
Figure 10:
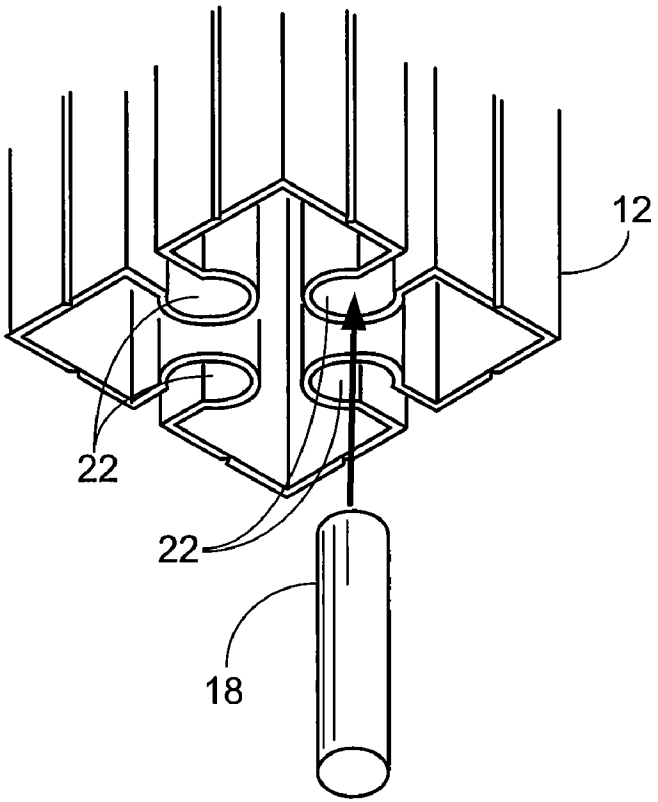
FIG. 10 is a perspective view of one embodiment of the bottom of a post and obstruction of the air conditioner cover of the present invention.
Figure 12:
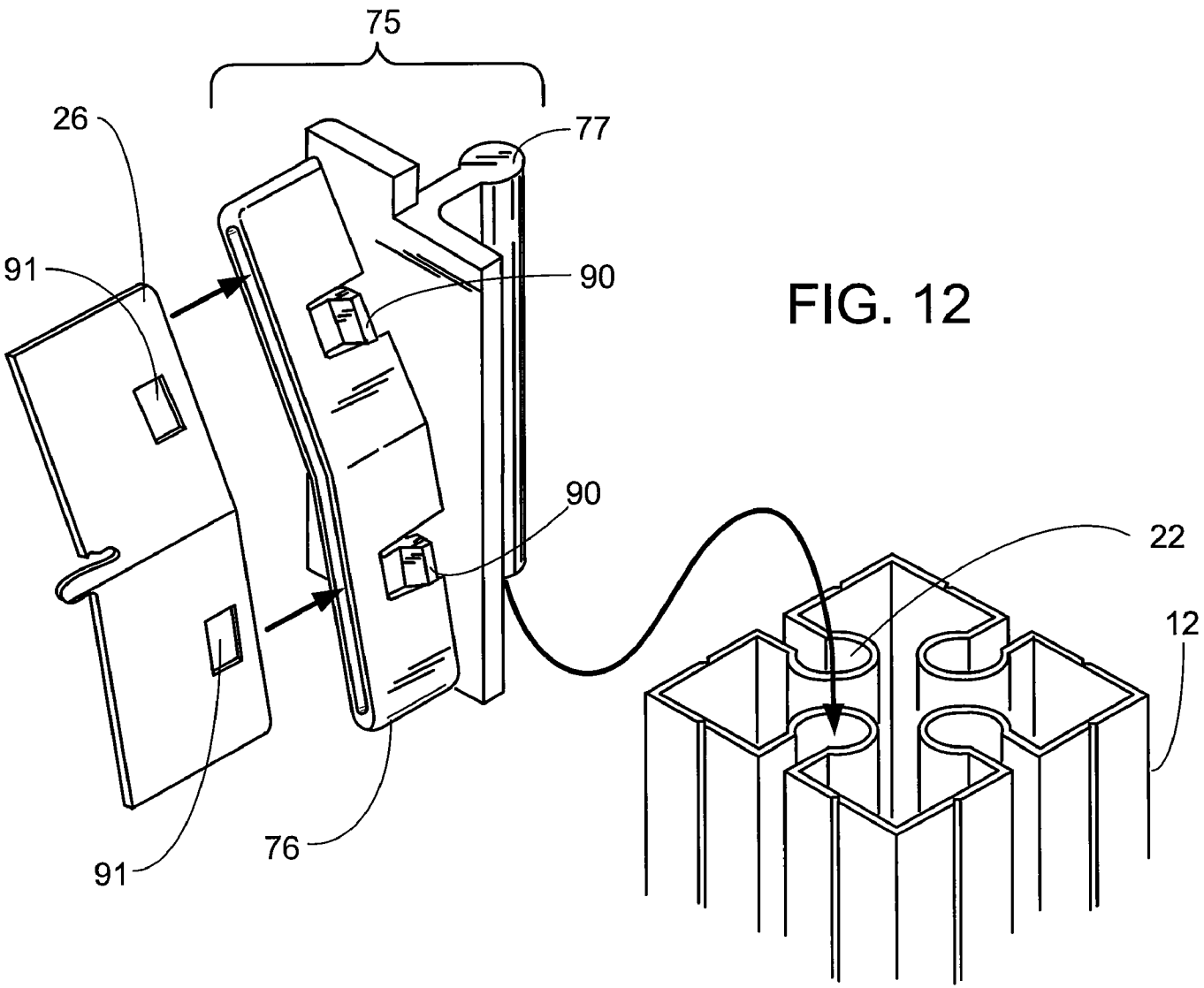
FIG. 12 is a perspective view of one embodiment of a connector and a post of the air conditioner cover of the present invention.

As shown in FIGS. 5 and 11, there is shown the obstruction 18 which prevents the lower most slat 16 from advancing toward the ground 58. In certain embodiments, the obstruction 18 may be properly sized to engage a groove 22, as best seen in FIGS. 1, 10, and 11 so that a slat 16, which is slideably engaged in the groove 22, is separated from the ground 58 by a distance which is equal to the length of the obstruction 18. The obstructions 18 may be constructed of any rigid material such as metal, plastic, fiberglass, and the like which may be used to support the weight of the plurality of slats 16 placed upon the obstruction 18. The obstruction 18 is responsible for providing a gap at the bottom of the air conditioner cover 10 in order to optimize the ventilation for the air conditioner unit 36. In certain embodiments, the obstruction 18 may be inserted in the groove 22 at the bottom of the post 12. (See FIG. 10) In certain embodiments, the obstruction 18 is attached to post 12 at a distance of six inches from the bottom of the post 12. In alternate embodiments in which slats 16 are permanently attached to rods 34, and posts 12 are not used, the obstruction 18 may be a device, such as a washer, or other flat piece of metal, or other rigid material, which attaches to the rods 34, in the common ways known in the art, in order to obstruct the lower most slat 16 from advancing towards the ground 58, as shown in FIGS. 5 and 7.

Figure 3C:
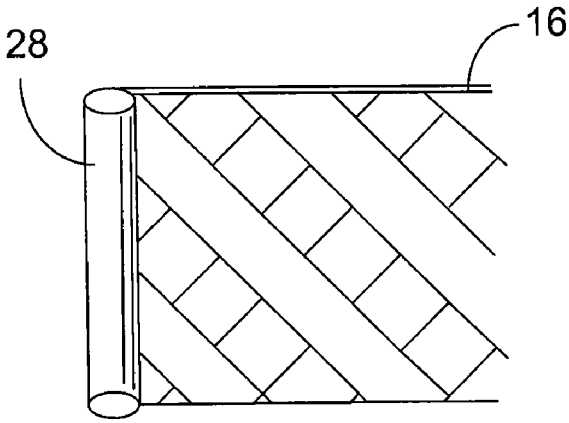
FIG. 3C shows a cross-sectional view of one embodiment of a slat of the air conditioner cover of the present invention.
Figure 6:
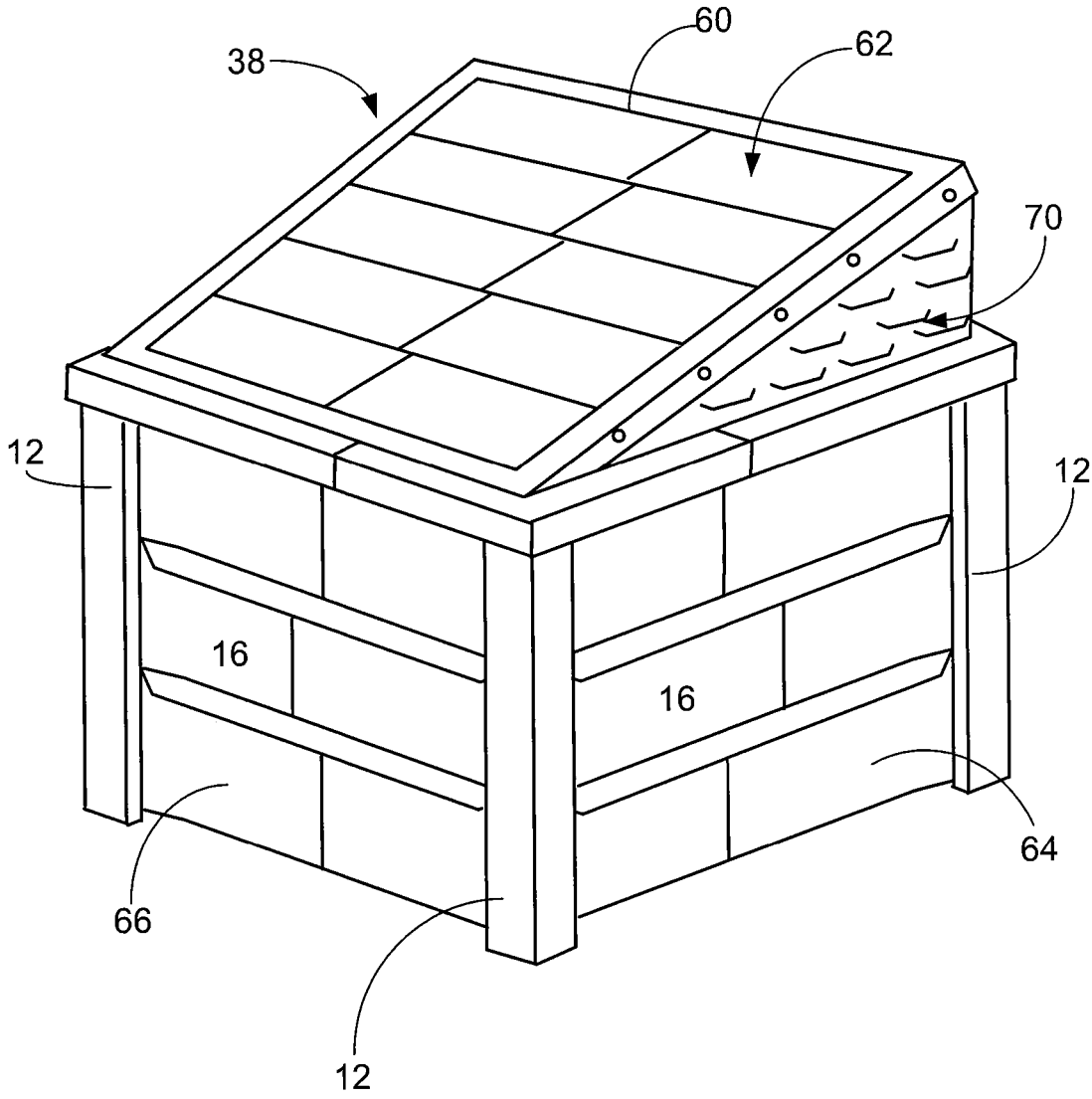
FIG. 6 is a perspective view of one embodiment of the air conditioner cover of the present invention.
Figure 8:
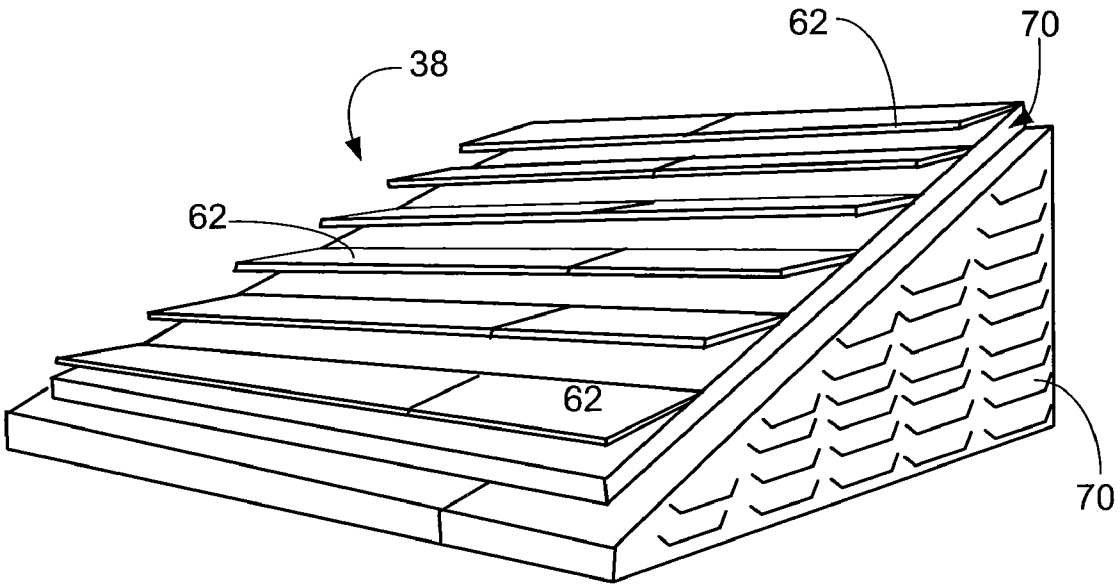
FIG. 8 is a perspective view of one embodiment of the top of the air conditioner cover of the present invention.

In still other embodiments, the present invention may include a top 38 in order to enclose the air conditioner unit 36. The top 38 includes a frame 60 and louvers 62. The frame 60 and louvers 62 are constructed of materials which are appropriate for construction of the slats 16 and posts 12. The frame 60 of the top 38 is adjustable so that it may be enlarged or reduced in order to accommodate the various lengths of the first side 64, second side 66 and third side 68, of the housing. In certain embodiments, the louvers 62 are attached to the frame 60 in order to allow swiveling so that bursts of exhausted air from the air conditioner unit 36 swivel the louvers 62 to an open position. The closed position is shown in FIG. 6 and the open position is shown in FIG. 8. In still other embodiments, the louvers 62 may be adjustable so that they are set to predetermined positions, such as fully open, partially open, and the like. In certain embodiments, the louvers 62 are adjustable in length and are constructed in a manner similar to the slats 16 as shown in FIG. 3C and further described herein. Accordingly, the louvers 62 may have a construction of a first member 42 and second member 44 which are slideably engaged in order to modify the length. In still other embodiments, when the top 38 is angled relative to the housing, which includes the first side 64, second side 66, and third side 68, the air conditioner cover may also include a side enclosure 70 attached to the frame 60. The side enclosure 70 may be constructed of vinyl, plastic, or the like. The function of the side enclosure 70 is to permit air flow if frame 60 and louvers 62 fail to allow ventilation.

All references, publications and patents disclosed herein are expressly incorporated by reference.

Thus, it is seen that the air conditioner cover of the present invention readily achieves the ends and advantages mentioned as well as those inherent therein. While certain preferred embodiments of the invention have been illustrated and described for the purposes of the present disclosure, numerous changes in the arrangement and construction of parts may be made by those skilled in the art, which changes are encompassed within the scope and spirit of the present invention, as defined by the following claims.

What is claimed is:

1. An air conditioner cover providing a visibility bather disposed adjacent to an air conditioning unit comprising:

a plurality of posts, each of said plurality of posts having a center vertical axis, a top and a bottom;

a plurality of slats having a first end and a second end, said slats removably attached to said plurality of posts whereby said first end is parallel with said center vertical axis of one post and said second end is parallel with said center vertical axis of another post thereby creating a first side;

a plurality of obstructions of a predetermined length attached to said bottoms of said plurality of posts such that said obstructions are parallel to said center vertical axis; and, a plurality of connectors disposed between said posts and said slats, each of said plurality of connectors having a guide for attaching to said plurality of posts and a slot for receiving an end of one of said plurality of slats.

2. The air conditioner cover of claim 1, wherein said obstruction is attached to the bottom of each of said plurality of posts creating a distance of said predetermined length between said bottom of each of said plurality of posts and each of said plurality of connectors.

3. The air conditioner cover of claim 1, wherein each of the plurality of slats has a first member and a second member, the second member being slidably engaged to the first member for horizontal movement such that the length of each of the plurality of slats is adjustable.

4. The air conditioner cover of claim 3 wherein each of said plurality of posts has at least one groove from said top of said bottom of said post and parallel to said center axis of said posts, said groove capable of receiving said guides of said plurality of connectors.

5. The air conditioner cover of claim 4 wherein an end of said first member of one of said plurality of slats is coupled with one of said slots; and an end of said second member of one of said plurality of slats is coupled with another of said slots.

6. The air conditioner cover of claim 5 wherein a second side is created pursuant to claim 1 and is adjacent to said first side; and a third side is created pursuant to claim 1 and is adjacent to said second side.

7. An air conditioner cover providing a visibility barrier disposed adjacent to an air conditioning unit, comprising:

At least two posts separated by a predetermined distance, each of said posts having a center vertical axis, a top and a bottom;

at least one groove in each of said posts from said top to said bottom and parallel to said center axis of said posts;

a plurality of connectors adjacent to said posts and attached thereto, each of said connectors having a guide and a slot, each of said guides removably disposed inside one of said grooves of one of said posts for vertical movement inside said groove from said top to said bottom of said post parallel to said center axis of said posts;

a plurality of slats each having a first end and a second end said first end removably engaged with said slot of one of said connectors attached to one of said posts; said second end removably engaged with said slot of another of said connectors attached to another of said posts, said plurality of slats so positioned between said posts and forming a first side; and at least two obstructions of a predetermined length removably disposed inside said grooves of said posts thereby creating a gap of said predetermined length between said bottom of said posts and said guide of said connectors for ventilation.

8. The air conditioner cover of claim 7 wherein each of the plurality of slats has a first member and a second member, the second member being slidably engaged to the first member for horizontal movement such that the length of each of the plurality of slats is adjustable.

9. The cover of claim 8, further comprising each of said second members having a first u-shaped portion at a top of said second member, a second u-shaped portion at a bottom of said second member, and a body there between; each of said first members disposed between said body and said u-shaped portions of one of said second members such that said second member is slidably engaged to said first member for horizontal movement.

10. The air conditioner cover of claim 7 wherein said plurality of slats have at least one hole in said first end and at least one hole in said second end, and said plurality of slots have a least one protrusion for engaging said holes thereby fastening said slat to said slot when said first or second end of one of said slats is engaged with said slot.

11. The air conditioner cover of claim 7 wherein said first side is adjacent to a second side.

12. The air conditioner cover of claim 11 wherein a third side is adjacent to said second side.

13. The air conditioner cover of claim 7 wherein said plurality of posts have a least two grooves; and a plurality of rods attached to said plurality of posts, said rods disposed inside said grooves of said posts, said rod protruding beyond said bottom of said post such that said rod can be inserted into the ground thereby stabilizing said post.

14. The air conditioner cover of claim 7 further comprising a post cap attached to said top of said posts.

* * * * *